US005601342A

United States Patent [19]

Perner

[11] Patent Number: 5,601,342

[45] Date of Patent: Feb. 11, 1997

[54] DEVICE FOR MOUNTING AND REMOVING SKATE WHEELS

[75] Inventor: Johann Perner, Graz, Austria

[73] Assignee: Koflach Sport Gesellschaft m.b.H. & Co. KG, Austria

[21] Appl. No.: 367,154

[22] PCT Filed: May 9, 1994

[86] PCT No.: PCT/AT94/00063

§ 371 Date: Jan. 10, 1995

§ 102(e) Date: Jan. 10, 1995

[87] PCT Pub. No.: WO94/26366

PCT Pub. Date: Nov. 24, 1994

[30] Foreign Application Priority Data

May 12, 1993 [AT] Austria ..... 934/93

[51] Int. Cl.[6] ..... A63G 17/00

[52] U.S. Cl. ..... 301/5.3; 301/124.2

[58] Field of Search ..... 301/5.3, 5.7, 110.5, 301/124.2; 280/11.22, 11.23, 11.19

[56] References Cited

U.S. PATENT DOCUMENTS 988,533 4/1911 Zverina .
4,805,941 2/1989 Downing et al. ..... 301/124.2 X
5,088,748 2/1992 Koselka et al. .
5,183,275 2/1993 Hoskin .
5,441,286 8/1995 Pozzobon ..... 280/11.27

FOREIGN PATENT DOCUMENTS 153259 12/1937 Austria .
2536290 5/1984 France .
668710 3/1952 United Kingdom .

*Primary Examiner*—Russell D. Stormer
*Attorney, Agent, or Firm*—Nixon & Vanderhye P.C.

[57] ABSTRACT

The device for inserting and removing rollers in single-row roller skates, in which the axles are inserted through aligned openings in a frame and are mounted therein, includes an axle having at one end a circumferential groove or engagement recess. Into the circumferential groove or engagement recess extends a removable locking member in the form of a pin or a hook, wherein the axle is secured in a given rotary position by adjusting a bolt lever (9). The rollers (15) of the roller skate are rotatably mounted on the said axle.

3 Claims, 2 Drawing Sheets

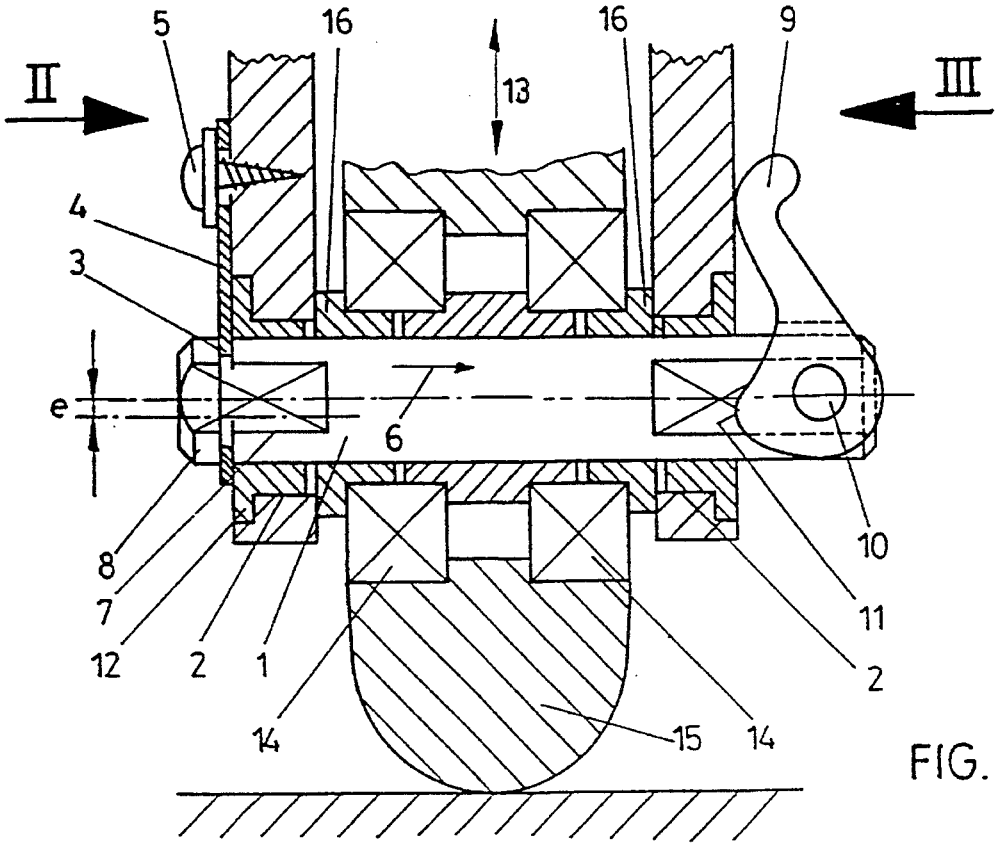
FIG. 1
FIG. 2
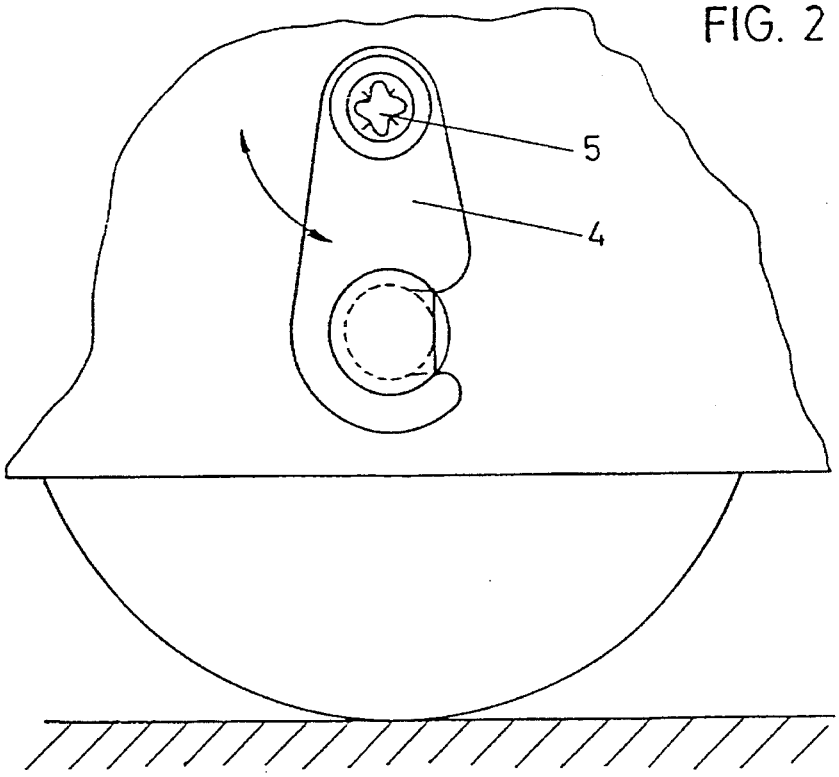

DEVICE FOR MOUNTING AND REMOVING SKATE WHEELS

The invention relates to a device for inserting and removing rollers in single-track roller skates, in which the roller axles are inserted into aligned openings of a frame and mounted in the openings, wherein the roller axle has, at one of its free ends, a circumferential groove or an opening, for receiving a removable locking member or pin.

In order to secure the rollers in this kind of single-row roller skates, it is already known, for example, to insert a bolt having a relatively large head into aligned openings through the roller, whereupon the free end is secured by a nut. For the exact mounting of rollers in a frame that can be connected to a shoe or can be made integral with the shoe, use can be made of mounting components in the openings of the frame, as is already known for example from U.S. Pat. No. 4,909,523. Also disclosed in U.S. Pat. No. 4,909,523 is the construction of a bearing component which makes possible two different vertical positions of the axles of the rollers, but in which, for this construction, it is a prerequisite that the opening in the frame be other than circular, so that the mounting components can be inserted into the openings in two different positions.

All known devices for securing such rollers require the use of monkey wrenches or Allen keys for the securement, and thus one must carry a particular tool for the replacement of rollers. Furthermore, with this kind of device for inserting and removing rollers, the components, and particularly the attachment components like nuts, are not secured against misplacement, and can thus become lost.

An aim of the invention is to provide a particularly simple apparatus in which the components required for the secure installation of axles and rollers can be secured easily against loss, and in which it is possible to quickly assemble or exchange parts without requiring the help of tools.

To attain this aim, the device according to the invention, based on the above-mentioned device, essentially requires that at the other end of the roller axle there be provided a bolt lever which is pivotally mounted transverse to the roller axle, and tightens the roller axle against the releasable locking member in a locking position. By providing the axle at one of its free ends with a circumferential groove or engagement recess, a locking member which is pivotable or is secured to a flexible tension member, for example a locking bolt or a pivotable hook, can be engaged with the circumferential groove or engagement recess, such that the axle can be secured against axial displacement in the direction of tension. In this construction, the securement can be obtained by providing a bolt lever at the other end of the axle, transverse to the axle, and pivotally connected, whereby a simple rotation of this bolt lever about the axle gives rise to an axial pull, resulting in an immediate tensioning of the axle against the removable locking member. Accordingly, a simple adjustment of a bolt lever results in a secure attachment, such that the axle and the roller can be removed by releasing the bolt lever, whereupon the locking pin or releasable locking member can be disengaged without requiring force, and the axle can be withdrawn. Accordingly, there is provided an axle which can be withdrawn particularly quickly without the help of tools, and in which all components necessary for the locking, can be secured against loss. This makes possible a quick replacement of rollers, especially to obtain different running characteristics.

In a particularly simple manner, the construction is so arranged that the releasable locking member has the form of a hook pivotally mounted about an axis parallel to the axle, the hook engaging the circumferential groove in the axle when in the locked position. This construction provides a locking member which lies flat against the side and is secured against loss, which locking member, due to the generally low weight, resists destruction even when hard to insert, and cannot be released from engagement without the simultaneous loosening of the bolt lever.

Alternatively, it is possible to use a pin or peg instead of the pivotal hook, wherein naturally the loss-protection incorporates a flexible attachment member, but this has the result that this kind of securement member can be destroyed when roughly inserted, whereby one loses the protection against loss in the roller-exchange phase.

However, with the device according to the invention, there is attained, and in a particularly simple manner, a height-adjustable securement of individual rollers and thus an exact adjustment of the vertical position.

This construction can advantageously be arranged such that the axle can be secured in a vertically and laterally adjustable manner relative to the frame, using a mounting component.

In what follows, the invention will be described in greater detail utilizing example embodiments which are schematically illustrated in the drawings. In the latter, FIG. 1 is a sectional view through an axis and one roller;

FIG. 2 is an elevational view in the direction of arrow II in FIG. 1;

Figure 3:
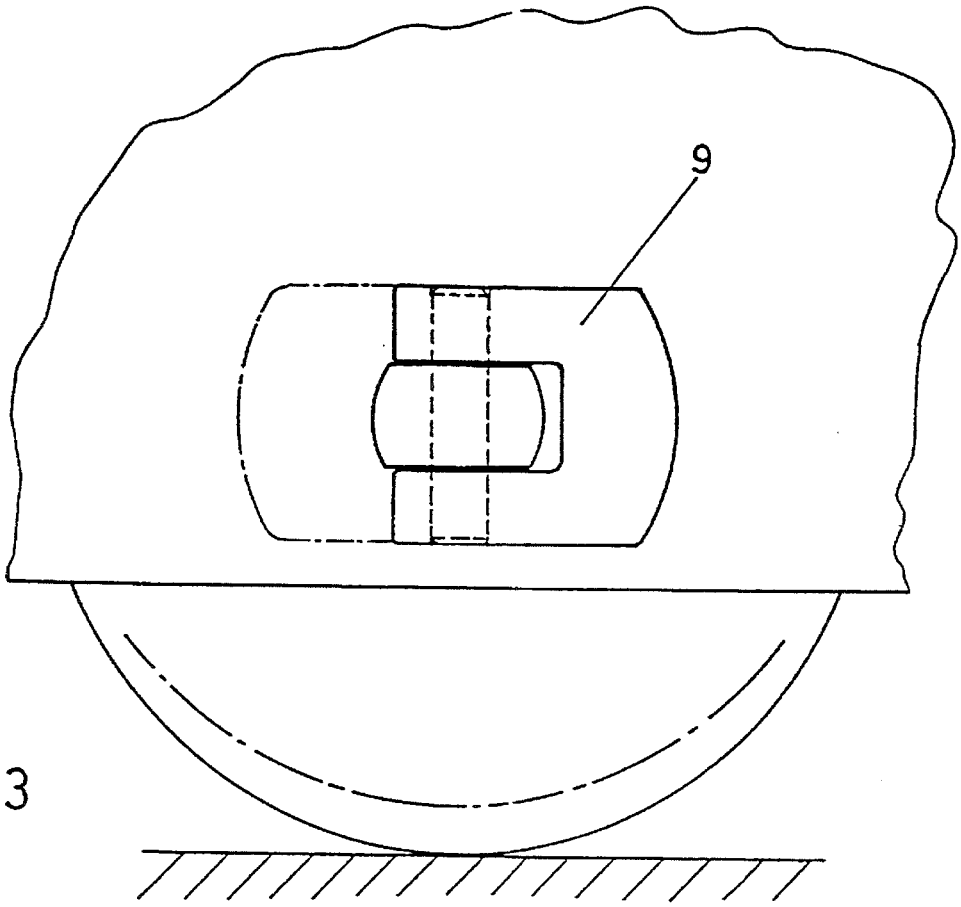
FIG. 3 is an elevational view in the direction of the arrow III in FIG. 1.

FIG. 1 illustrates an axle 1 projecting through openings 2 in a frame. The axle 1 has at one free end a circumferential groove or engagement recess 3, in which a hook-shaped locking member 4 engages, as is clearly seen in FIG. 2, by pivoting about the axis 5, thus restraining the axle 1 from being pulled out in the direction of the arrow 6.

The circumferential groove or engagement recess can be provided, in a particularly simple manner, by providing in the free end of the axle 1 a blind bore 7 which is internally threaded, and in which a screw 8 can be screwed, whereby between the end face of the axle 1 and the head of the screw 8 there remains the circumferential groove in which the pivotally mounted locking lever or hook 4 engages. The end of the axle 1 which is opposite the end whose position is determined by the hook 4 includes a bolt lever 9 which is pivotally mounted about a pivot pin or axle 10. In the illustrated closed position, an eccentric cam 11 abuts the outside of the bearing component 12, resulting in the axle 1 being pulled in the direction of the arrow 6 between the bearing components 12 which are lodged in the openings of the frame. The mentioned bearing components 12 have an eccentric configuration, so that, by rotating these bearing components 12, the vertical position of the axle 1 is adjustable in the direction of the double arrow 13, wherein naturally the locking member formed by the hook 4 follows the vertical position of the axle 1 relative to the axis 5.

Rollers 15 are rotatably mounted about the axle 1 by the insertion of bearings 14.

As already mentioned, FIG. 2 is an elevational view of the hook-shaped locking member 4. As an alternative to the hook-shaped locking member, it is possible, especially when eccentric inserts are to be used, to provide a pin which extends through the axle. In order to ensure that, in the locked condition where the bolt lever 9 has been pushed to its closure position, the side walls of the frame do not contact the rollers, spacer rings 16 are provided, as can be seen in FIG. 1.

As illustrated in FIG. 3, the bolt lever 9 can be swivelled to any desired rotary position, such that with a non-rotational connection to the eccentric components 12, a particular eccentricity can be attained in accordance with the selected rotary position, this being illustrated in FIG. 1. The bolt lever 9 is illustrated in FIG. 3, in the side elevation corresponding to the arrow III.

Figure 4:
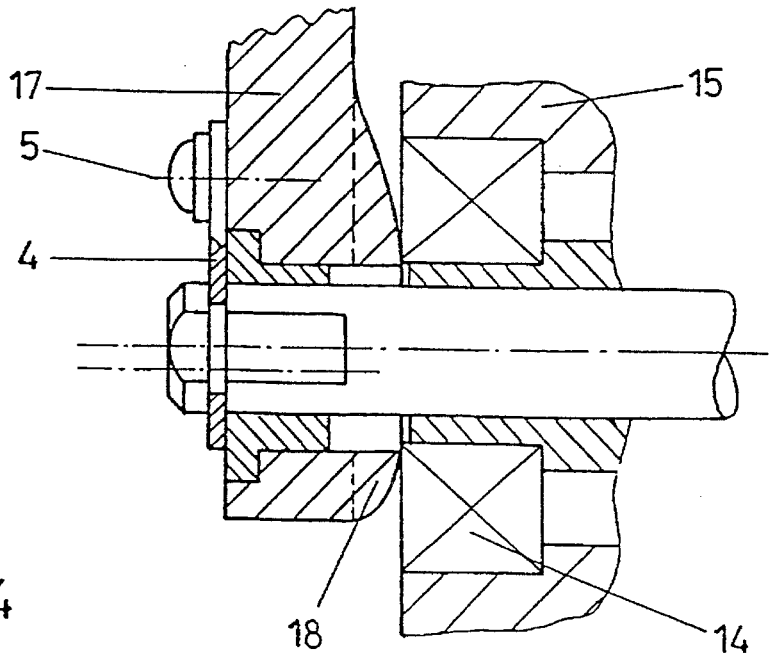
FIG. 4 is a detailed drawing of the configuration of the roller mount corresponding to the sectional view of FIG. 1.

In the configuration according to FIG. 4, spacer elements 18 integral with the side walls 17 of the frame are provided. The remaining numerals correspond to those in FIG. 1.

I claim:

1. A device for mounting and removing rollers in single-track roller skates, in which roller axles are inserted through aligned openings of a frame and are mounted in the openings, and in which at least one roller axle has at one of its free ends an engagement recess for receiving a removable locking member, the device comprising a bolt lever rotatably mounted on a pivot pin extending perpendicular to the roller axle at the other of said free ends of the roller axle, said bolt lever having a cam surface which in a locking position, forces the roller axle against the removable locking member.

2. A device according to claim 1 wherein the removable locking member comprises a hook pivotal about an axis which is substantially parallel to the roller axle, the hook when in the locked condition projecting into the engagement recess of the roller axle.

3. A device according to claim 1 wherein the roller axle extends through a pair of eccentric, rotatable bearing components such that said roller axle is adjustable in a vertical direction, and wherein said roller axle is lockable by said bolt lever.

* * * * *